US006729091B1

(12) United States Patent
Martensson

(10) Patent No.: US 6,729,091 B1
(45) Date of Patent: May 4, 2004

(54) FLOOR ELEMENT WITH GUIDING MEANS

(75) Inventor: Göran Martensson, Klagstorp (SE)

(73) Assignee: Pergo (Europe) AB, Trelleborg (SE)

( * ) Notice: Subject to any disclaimer, the term of this patent is extended or adjusted under 35 U.S.C. 154(b) by 0 days.

(21) Appl. No.: 10/019,649

(22) PCT Filed: Jun. 30, 2000

(86) PCT No.: PCT/SE00/01385

§ 371 (c)(1),
(2), (4) Date: Feb. 22, 2002

(87) PCT Pub. No.: WO01/02672

PCT Pub. Date: Jan. 11, 2001

(30) Foreign Application Priority Data

Jul. 5, 1999 (SE) ..... 9902559

(51) Int. Cl.[7] ..... E04F 13/08
(52) U.S. Cl. ..... 52/391; 52/585.1; 446/112
(58) Field of Search ..... 52/391, 392, 311.2, 52/585.1, 177; 15/238; 404/34, 35, 40, 46; 446/112, 108, 111, 115

(56) References Cited

U.S. PATENT DOCUMENTS

| | | | | |
|---|---|---|---|---|
| 2,015,813 A | | 10/1935 | Nielsen | |
| 2,831,223 A | * | 4/1958 | DeShazor, Jr. | 52/585.1 |
| 3,141,392 A | * | 7/1964 | Schneider et al. | 52/582.2 |
| 4,158,335 A | * | 6/1979 | Belcastro | 108/64 |
| 4,571,910 A | * | 2/1986 | Cosentino | 52/391 |
| 5,623,799 A | * | 4/1997 | Kowalski et al. | 52/392 |
| 6,189,283 B1 | * | 2/2001 | Bentley et al. | 52/587.1 |

FOREIGN PATENT DOCUMENTS

| | | |
|---|---|---|
| DE | 2101782 | 7/1972 |
| DE | 3306609 | 9/1984 |
| EP | 0652340 | 5/1995 |
| GB | 1212983 | 11/1970 |

* cited by examiner

*Primary Examiner*—Carl D. Friedman
*Assistant Examiner*—Naoko Slack
(74) *Attorney, Agent, or Firm*—Stevens, Davis, Miller & Mosher, L.L.P.

(57) ABSTRACT

Floor element (1), which is mainly in the form of a board with triangular, quadratic, rectangular, rhomboidal or polygonal shape as seen from above. The floor element (1) is provided with edges (2), a lower side (7) and a decorative upper layer (3). The floor elements (1), which are intended to be joined via tongue and groove are on at least two opposite edges (2), preferably on all edges (2) provided with holes (4). The holes (4) extends inwards from the edge (2) mainly parallel to the decorative upper layer (3). The holes (4) are arranged on a predetermined distance from the decorative upper layer (3) and on a predetermined distance from a closest corner between two adjacent edges (2), whereby the holes (4) are intended to receive each one part of a guiding means (6).

16 Claims, 5 Drawing Sheets

FIG. 4
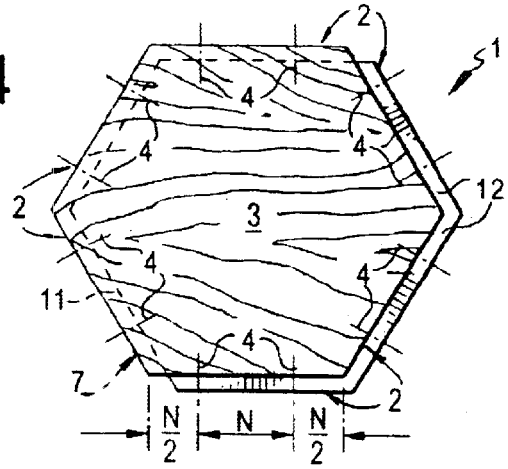
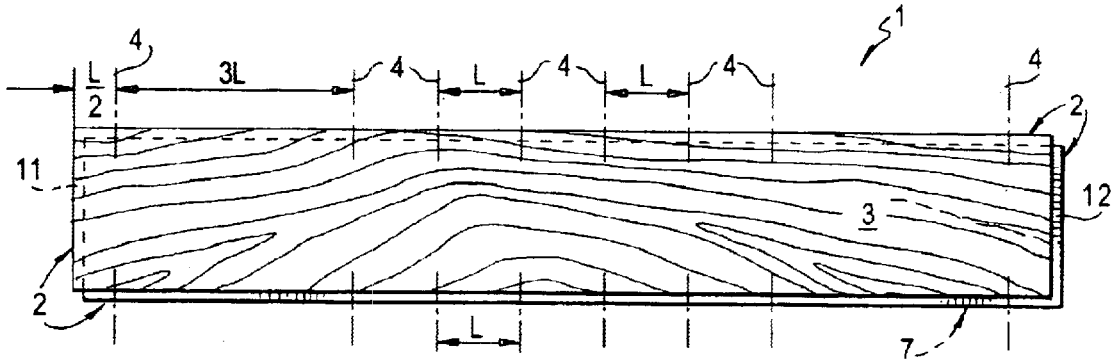
FIG. 5
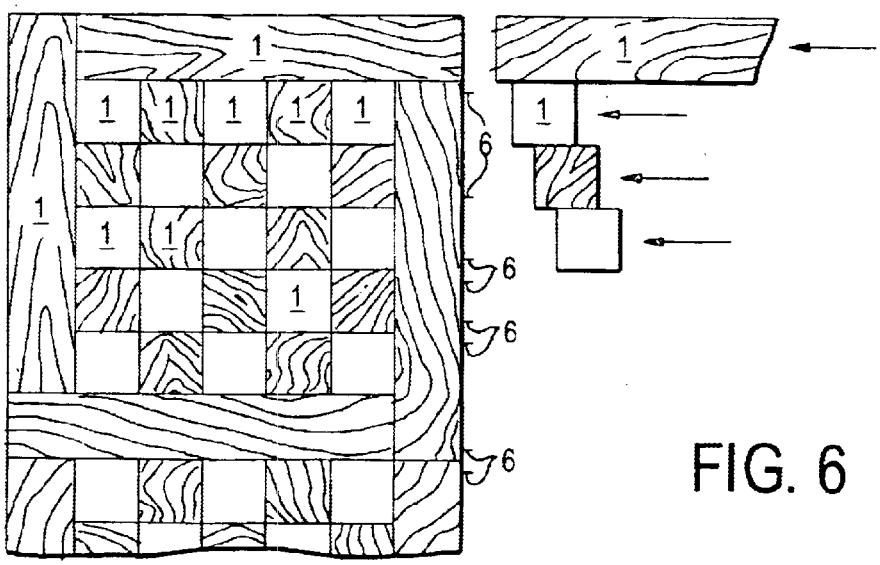
FIG. 6

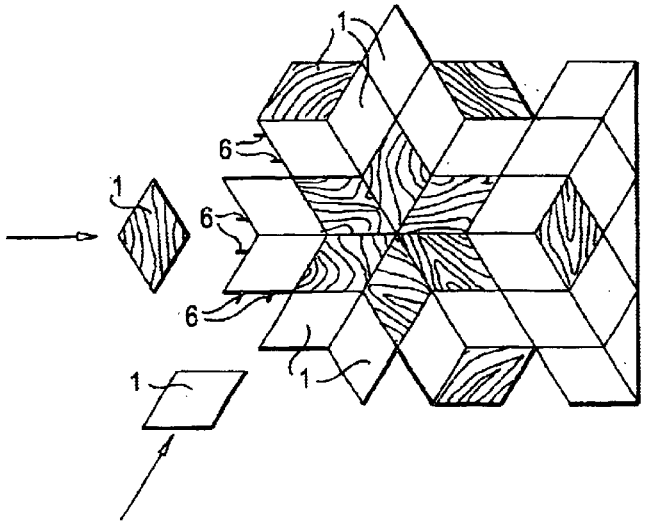
FIG. 10
FIG. 11
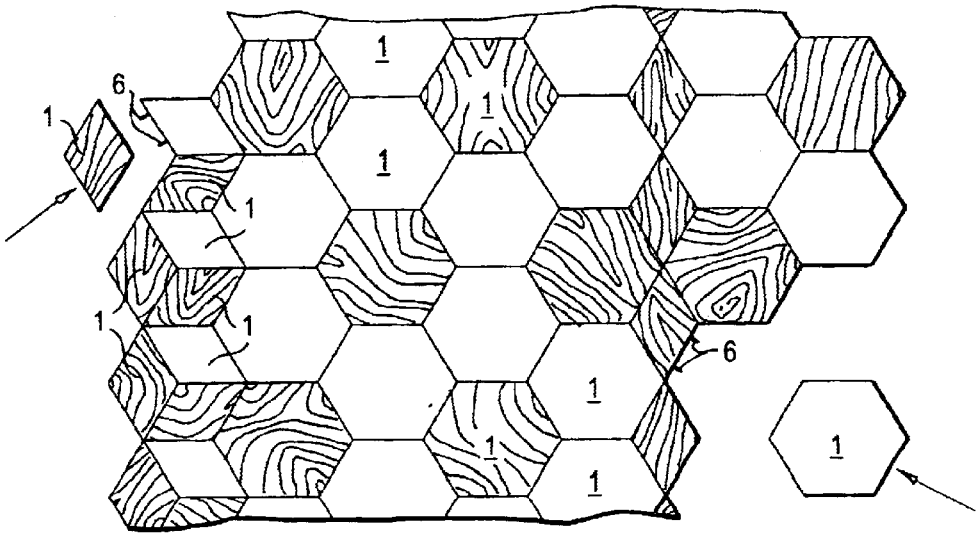
FIG. 12
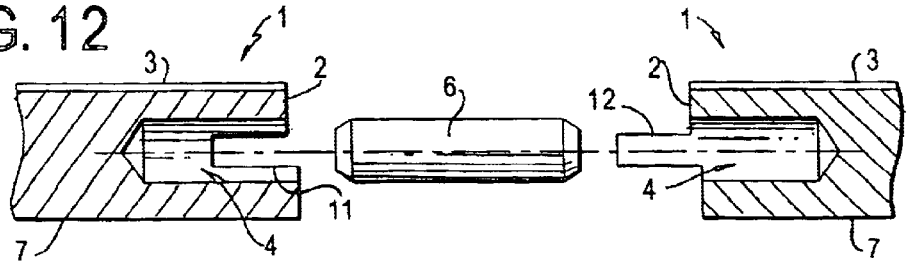

FLOOR ELEMENT WITH GUIDING MEANS

This application has been filed under 35 USC § 371, claiming priority from PCT/SE00/01385, filed on Jun. 30, 2000, which claims priority from SE 9920559-5, filed on Jul. 5, 1999.

The present invention relates to floor elements which are joined by means of tongue, groove and separate guiding means.

Prefabricated board shaped floor elements which are provided with tongue and groove at the edges are common nowadays. They are very easy to install whereby this can be accomplished by the average handy man. Such floor elements can, for example, be made of solid wood, fibre board or particle board. These are most often provided with a surface layer such as a lacquer or some type of laminate. The boards are most often installed by being glued together via tongue and groove. This type of floor is usually installed so that the boards overlap and the latitudinal joint do not coincide. It has therefore not been any reason to guide the relative longitudinal position between the boards. Designed installations is very difficult to achieve without this possibility. One example where it should be desirable to have coinciding latitudinal as well as longitudinal joint is completely quadratic floor elements. This is very difficult as scales or a very sure eye and great workman skills is required if a successful end result is to be achieved. It is furthermore very easy to dislodge already installed floor elements when installing new ones. It is also sometimes desired to have latitudinal joints coincide over, for example, every other or every third latitudinal joint, when installing with overlap.

This requirement is foremost present when floor boards with dissimilar decor is used for creating a decorative effect on larger floor surfaces. This requirement goes for quadratic as well as rectangular floor elements.

It has, through the present invention, been made possible to solve the above mentioned problems, whereby a designed floor installation, even with complex patterns, easily can be installed with great accuracy, even by the average handyman. Thus, the invention relates to floor elements which are mainly in the form of boards with triangular, quadratic, rectangular, rhomboidal or polygonal shape as seen from above. The floor elements are provided with edges, a lower side and a decorative upper layer. The floor elements are intended to be joined by means of tongue and groove. The invention is characterised in that the floor elements are provided with holes in at least two opposite edges, preferably all four edges, which holes extends inwards from the edge mainly parallel with the upper layer. The holes arc arranged at a predetermined distance from the upper decorative layer and at a predetermined distance from the closest edge between two adjacent edges. The holes are intended to receive one part of a guiding means each.

The holes preferably extends perpendicular to the edge where the holes are arranged. Alternatively, the holes extends parallel to the edge which is adjacent to the edge where the holes are arranged. In cases where the corners of the floor boards are right-angled the holes preferably extends perpendicular to the edge where they are arranged and parallel to the edge which is adjacent to the edge where they are arranged.

According to one embodiment of the invention the floor element has four edges with the same length. Each edge is suitably provided with each one hole group of two holes. The holes have, in each hole group, been arranged on a mutual distance of N from each other and that the distance between a hole and its closest edge is N/2, whereby the length of the edge is 2N.

According to a second embodiment of the invention the floor element has two opposite edges with larger length than the two remaining edges. The two shorter edges are suitably provided with each one hole group of two holes. The holes have, in each hole group, been arranged on a mutual distance of N from each other and that the distance between a hole and its closest edge is N/2, whereby the length of the edge is 2N. The two long side edges are provided with each one, hole group of three or more holes of which the outermost are arranged on a distance of L/2from the closest edge while the distance between two adjacent holes arranged on the long sides is L, whereby the length of the long side edge is an integer larger than 3L, preferably smaller than 30L.

The two long side edges are alternatively provided with each one hole group of three or more holes, of which the outermost holes are arranged on a distance of L/2from the respective closest corner between two adjacent edges. The distance between two adjacent holes arranged on the long side edge is L, 2L, 3L, 4L, 5L or combinations thereof. The length L is in both cases suitably equal to the length N.

The holes are suitably provided with an inner, gripping edge. The holes are thereby suitably provided with an inner gripping edge by milling a groove from the lower side. This groove is then suitably perpendicular to the hole and thereby parallel to the edge where the hole, which is intersected by the groove, is arranged. The hole may alternatively be provided with an inner gripping edge by milling a step with larger diameter than the hole, on a predetermined depth.

The guiding means are then suitably provided with each two ends which each are provided with one or more resilient projections. These projections are intended to interact with the gripping edges of the holes.

The invention is further illustrated by means of enclosed figures showing different embodiments of a flooring material according to the present invention whereby, FIG. 1*a* shows, seen from above, an embodiment of a floor element 1 with a quadratic surface.

FIG. 1*b* shows the embodiment from FIG. 1*a* showed from the side.

FIG. 4 shows, seen from above, yet another embodiment of a floor element 1 with a hexagonal surface.

FIG. 5 shows, seen from above, yet another embodiment of a floor element 1 with a rectangular surface.

FIG. 6 shows, seen from above an embodiment of the invention where quadratic floor elements 1 according to FIG. 1 and rectangular floor elements 1 according to FIG. 5 together forms a so-called designed installation.

FIG. 10 shows, seen from above, an embodiment where rhomboidal floor elements according to FIG. 2 forms a so-called designed installation.

FIG. 11 shows, seen from above, an embodiment of the invention where rhomboidal floor elements according to FIG. 2 and hexagonal floor elements according to FIG. 4 together forms a so-called designed installation.

FIG. 12 shows, in cross-section, parts of two floor elements 1 and a guiding means 6 according to one embodiment of the invention.

Figure 1A:
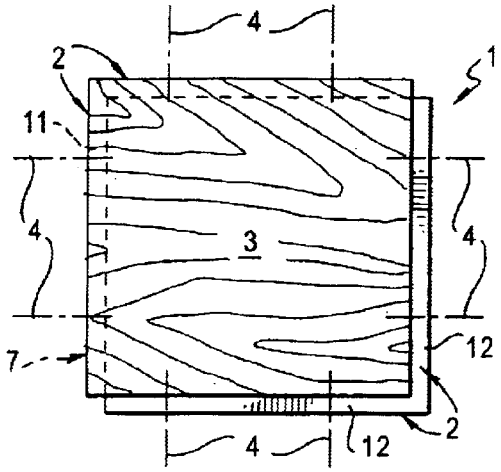
Figure 1B:
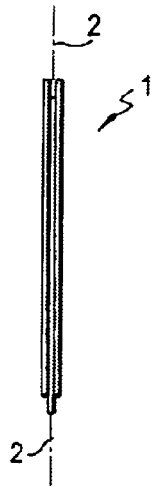

Accordingly, FIG. 1*a* shows, seen from above, an embodiment of a floor element 1 with a quadratic surface, while FIG. 1*b* shows the embodiment from FIG. 1 as seen from the side. The floor element 1 is provided with edges 2, a lower side 7 and a decorative upper layer 3. The floor element 1 is also provided with groove 11 and tongue 12. The floor element 1 is in all edges 2 provided with holes 4, which holes extends inwards from the edge 2 mainly parallel to the upper decorative layer 3. The holes 4 are intended to receive each one part of a guiding means 6 (FIG. 12). The holes 4 extends parallel to the edge 2 which is closest adjacent to the edge 2 where the holes 4 are arranged. The floor elements 1 are on each edge 2 provided with each one hole group of two holes 3. The holes have, in each hole group, been arranged on a mutual distance of N. The distance between each hole 4 and its closest corner between two adjacent edges is N/2, the length of the edge is hereby 2N.

Figure 2:
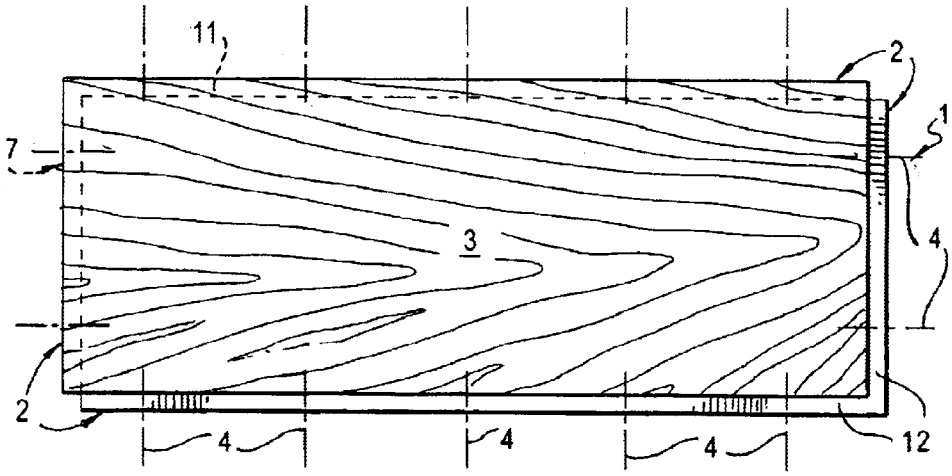
FIG. 2 shows, seen from above, a second embodiment of a floor element 1 with a rectangular surface.

FIG. 2 shows, seen from above, a second embodiment of a floor element 1 with a rectangular surface. The floor element 1 is provided with edges 2, a lower side 7 and a decorative upper layer 3. The floor element 1 is also provided with groove 11 and tongue 12. The floor element 1 is in all edges 2 provided with holes 4, which holes extends inwards from the edge 2, mainly parallel to the upper decorative surface 3. The holes 4 are intended to receive each one part of a guiding means 6 (FIG. 12). The holes 4 extends parallel to the edge 2 which is closest adjacent to the edge 2 where the holes 4 are arranged. The two shorter edges 2 are each provided with each one hole group of two holes 4, which holes have, in each hole group, been arranged on a mutual distance of N. The distance between each hole 4 and its closest corner between two adjacent edges is N/2. The length of the edge is hereby 2N. The two longer edges are provided with one hole group of five holes 4 each. The outermost holes has been arranged on a distance L/2 from its respective closest edge 2 while the distance between two adjacent holes 4, on the two longer edges 2, is L. The length of the longer edge 2 is thereby 5L. The length L is equal to the length N.

Figure 3:
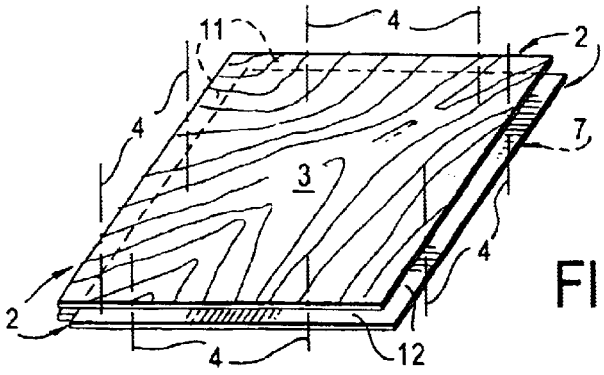
FIG. 3 shows, seen from above, yet another embodiment of a floor element 1 with a rhomboidal surface.

FIG. 3 shows, seen from above, yet another embodiment of a floor element 1 with rhomboidal surface. The floor element 1 is provided with edges 2, a lower side 7 and a decorative upper layer 3. The floor element 1 is also provided with groove 11 and tongue 12. The floor element 1 is in all edges 2 provided with holes 4, which holes extends inwards from the edge 2, mainly parallel to the upper decorative surface 3. The holes 4 are intended to receive each one part of a guiding means 6 (FIG. 12). The holes 4 extends parallel to the edge 2 which is closest adjacent to the edge 2 where the holes 4 are arranged.

According to an alternative embodiment the holes extends parallel to the edge 2 which is adjacent to the edge 2 where the holes 4 are arranged. This orientation of the holes 4 facilitates certain forms of design installations.

The floor clement 1 is on all edges 2 provided with each one hole group of two holes 4. The holes 4 have, in each hole group, been arranged on a mutual distance of N. The distance between each hole 4 and its closest corner between two adjacent edges is N/2. The length of the edge is hereby 2N.

FIG. 4 shows, seen from above, yet another embodiment of a floor element 1 with a hexagonal surface. The floor element 1 is provided with edges 2, a lower side 7 and a decorative upper layer 3. The floor element 1 is also provided with groove 11 and tongue 12. The floor element 1 is on all edges 2 provided with holes 4, which holes 4 extends inwards from the edge 2, mainly parallel to the upper decorative surface 3. The holes 4 are intended to receive each one part of a guiding means 6 (FIG. 12). The holes 4 extends parallel to the edge 2 which is closest adjacent to the edge 2 where the holes 4 are arranged. The floor element 1 is on all edges 2 provided with each one hole group of two holes 4. The holes 4 have, in each hole group, been arranged on a mutual distance of N. The distance between each hole 4 and its closest corner between two adjacent edges is N/2. The length of the edge is hereby 2N.

FIG. 5 shows, seen from above, yet another embodiment of a floor element 1 with rectangular surface. The floor element 1 is provided with edges 2, a lower side 7 and a decorative upper layer 3. The floor element 1 is also provided with groove 11 and tongue 12. The floor element 1 is in all edges 2 provided with holes 4, which holes extends inwards from the edge 2, mainly parallel to the upper decorative surface 3. The holes 4 are intended to receive each one part of a guiding means 6 (FIG. 12). The holes 4 extends perpendicular to the edge 2 where the holes 4 are arranged. The holes 4 furthermore extends parallel to the edge 2 which is closest adjacent to the edge 2 where the holes 4 are arranged. The two longer edges 2 are provided with one hole group of eight holes 4 each. The outermost holes has been arranged on a distance L/2 from its respective closest edge 2 while the distance between two adjacent holes 4, on the two longer edges 2, is L and 3L respectively. The length of the longer edge 2 is thereby 12L. The length of the shorter edges 2 is 2L.

The floor element may also, as shown in FIG. 2, be provided with holes 4 on the two shorter edges 2. These edges 2 are then provided with one hole group of two holes 4 each. The holes 4 are then arranged with a mutual distance of L. The distance between each hole 4 and its closest corner between two edges 2 are L/2. The length of the edge 2 is as before 2L.

FIG. 6 shows, seen from above, an embodiment of the invention where quadratic floor elements 1 according to FIG. 1 and rectangular floor elements 1 according to FIG. 5 together forms a designed installation. Tongue 12 and groove 11 is for the matter of clarity not shown. The quadratic floor elements 1 corresponds completely to the one shown in FIG. 1. The rectangular floor elements 1 correspond mainly with the one shown in FIG. 5, the two shorter edges are however provided with holes 4 which corresponds to the edges 2 of the quadratic floor element 1. The installation can accordingly be initiated by joining five quadratic floor elements 1 by means of one or two guiding means 6 (FIG. 12) per floor element so that a rectangular unit is formed. This may then be joined with a rectangular floor element 1 by means of one or more guiding means so that a part corresponding to 2L of the longer edge on the floor element 1 is left free. The quadratic floor elements 1 may alternatively be joined directly with the rectangular floor element 1 without first having to be joined with each other.

Another rectangular floor element 1 is then joined at an angle, with the already joined floor elements 1. One or more guiding means are used also here for the positioning of the floor elements 1. Further quadratic floor elements 1 are added to the already installed floor elements 1 until a square consisting of twenty-five quadratic floor elements 1 is formed. Another two rectangular floor elements 1 are then assembled at an angle so that the four rectangular floor elements 1 together forms a frame around the quadratic floor elements 1. Guiding means 6 are foremost used for the positioning the rectangular floor elements 1 to each other as they give the main shape of the installation pattern. Guiding means 6 should however be used on at least every first row of quadratic floor elements 1. The arrows illustrates how further floor elements 1 are joined with the previously installed.

A floor element 1 most often includes a core covered with an upper decorative layer 3. The core is most often comprised by wood particles or wood fibre bonded with resin or glue. It is advantageous to surface treat the area around the joint if the floor is to be exposed to moisture since the wood of the core is sensitive to moisture. This surface treatment may suitably include resin, wax or some kind of lacquer. It is not necessary to surface treat the joint if it is to be glued as the glue itself will protect the core from moisture penetration. The decorative upper layer 3 is constituted by a decorative paper impregnated with melamine formaldehyde resin. One or more layers of so-called overlay paper of α-cellulose which is impregnated melamine formaldehyde resin may possibly be placed on top of this. One or a few of these layers may be sprinkled with hard particles of a-aluminium oxide, silicon carbide or silicon oxide during the impregnation in order to improve the abrasion resistance. The lower side 7 may suitably be surface treated with lacquer or a layer of paper and resin.

Figure 7:
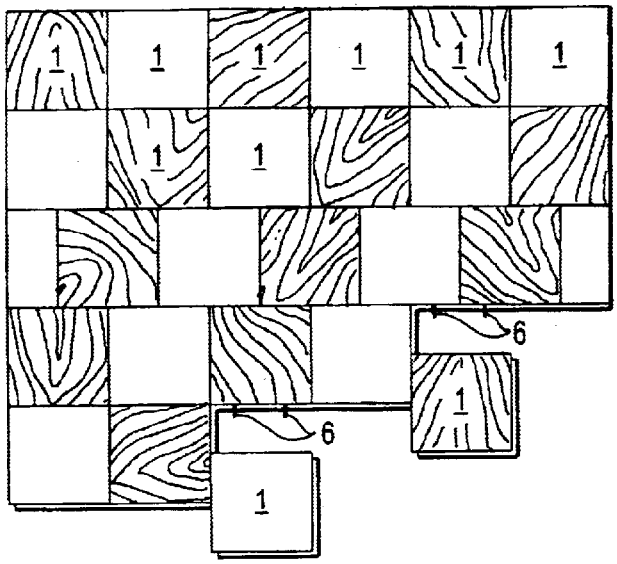
FIG. 7 shows, seen from above, an embodiment of the invention where quadratic floor elements from FIG. 1 forms a so-called designed installation.

FIG. 7 shows, seen from above, an embodiment of the invention where quadratic floor elements 1 according to FIG. 1 forms a so-called designed installation. The quadratic floor elements 1 corresponds completely with the ones shown in FIG. 1. The installation can accordingly be initiated by joining quadratic floor elements 1 by means of one or two guiding means 6 (FIG. 12) per floor element 1 so that a unit is formed. The floor elements 1 can be joined so that both longitudinal and latitudinal joints coincides or so that the longitudinal and latitudinal joints are displaced by 1N meaning half of the floor element edge. Guiding means 6 are foremost used for positioning the rows towards another so that the latitudinal joints coincides over the whole floor without forming curves. It is not necessary to use guiding means 6 on every floor element 1. Guiding means 6 should, however, at least be used when joining the outer rows of quadratic floor elements 1.

Figure 8:
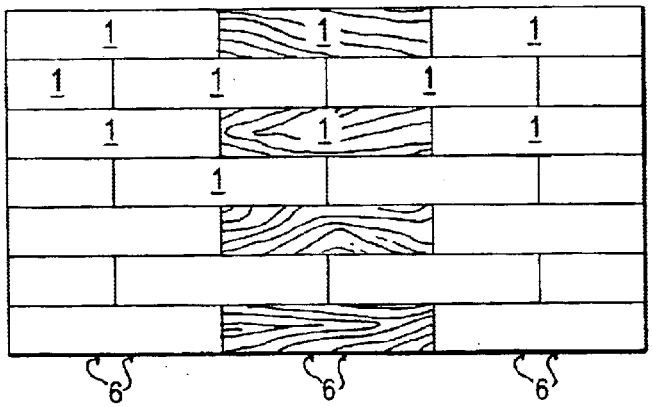
FIG. 8 shows, seen from above, an embodiment of the invention where rectangular floor elements according to FIG. 2 forms a so-called designed installation.

FIG. 8 shows, seen from above, an embodiment of the invention where rectangular floor elements according to FIG. 2 forms a so-called designed installation. The groove 11 and tongue is for the sake of clarity not shown. The rectangular floor elements 1 corresponds completely with the one shown in FIG. 2. The installation can accordingly be initiated by joining two or more floor elements to a row by means of on or more guiding means 6 (FIG. 12) per floor element 1 so that a unit is formed. Further rows are then added to this first row. At least one guiding means 6 per row is used. These should be placed closest to the most visible pattern, which in the FIG. 8 is illustrated by a number of darker boards, comparable to a crosswalk, if only a few guiding means 6 is used. It is however advantageous to use a full set of guiding means 6 when installing at least the first row of floor elements 1.

Figure 9:
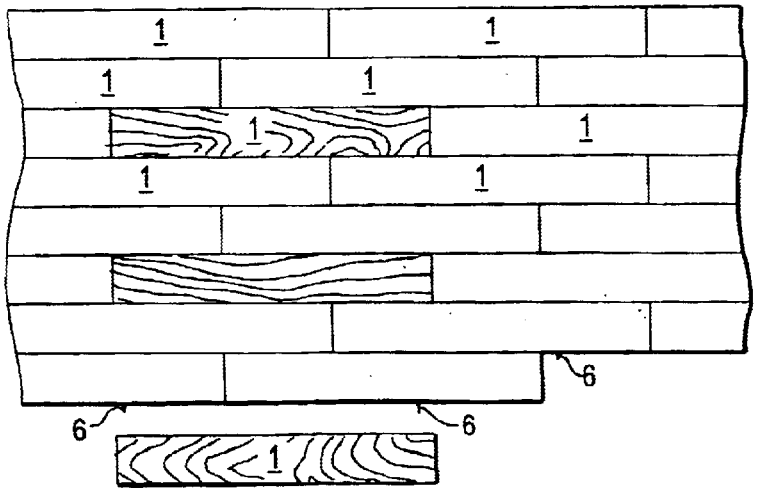
FIG. 9 shows, seen from above an embodiment of the invention where rectangular floor elements according to FIG. 5 forms a so-called designed installation.

FIG. 9 shows, seen from above, an embodiment of the invention where rectangular floor elements 1 according to FIG. 5 forms a so-called designed installation. The groove 11 and tongue is for the sake of clarity not shown. The installation corresponds in the main with the one illustrated in FIG. 8. The floor is however installed so that the latitudinal joints coincides over every third row. The arrow illustrates how next design carrying floor element 1 is joined with the previously installed ones.

FIG. 10 shows, seen from above, an embodiment of the invention where rhomboidal floor elements according to FIG. 3 forms a more advanced designed installation. The holes 4 (FIG. 3) are however arranged parallel to the edge 2 which is closest to the edge 2 where the holes 4 are arranged. The groove 11 and tongue is for the sake of clarity not shown. Six rhomboidal floor elements 1 with a dark design is assembled by means of guiding means 6 so that the shape of a six-pointed star is formed, a number of rhomboidal floor elements 1 with a lighter design may then be joined around the already installed floor elements 1 by means of guiding means 6. Arrows illustrate how further floor elements 1 are joined with the already installed ones.

FIG. 11 shows further, seen from above, an embodiment of the invention where rhomboidal floor elements 1 according to FIG. 2 and hexagonal floor elements according to FIG. 4 together forms an advanced designed installation. The holes 4 (FIG. 3) of the rhomboidal floor elements 1 are however arranged parallel to the edge 2 which is closest to the edge 2 where the holes 4 are arranged. The groove 11 and tongue is for the sake of clarity not shown. The floor elements 1 are gradually joined by means of guiding means 6. Arrows illustrate how further floor elements 1 are joined with the previously installed.

FIG. 12 shows, in cross-section, parts of two floor elements 1 and one guiding means 6 according to one embodiment of the invention. The floor elements 1 are provided with edges 2, a lower side 7 and a decorative upper layer 3. The floor elements 1 are intended to be joined by means of tongue 12 and groove 11. The floor elements 1 are at their edges 2 provided with holes 4, which holes 4 extends inwards from the edge 2 mainly parallel with the decorative upper layer 3. The holes are arranged on a predetermined distance from the decorative upper layer 3 and on a predetermined distance from the closest corner (FIG. 1) between two adjacent edges 2. The holes 4 are intended to each receive one part of a guiding means 6.

Figure 13:
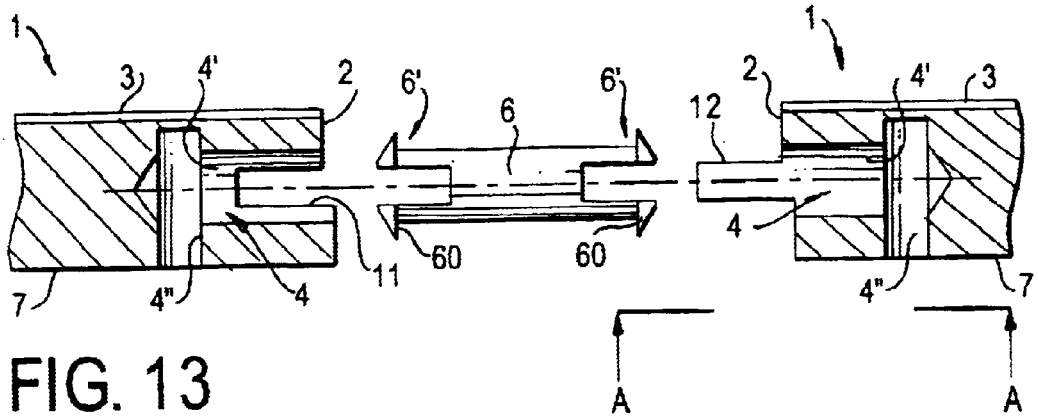
FIG. 13 shows, in cross-section, parts of two floor elements 1 and a guiding means 6 according to a second embodiment of the invention.

FIG. 13 shows, in cross-section, parts of two floor elements 1 and one guiding means 6 according to another embodiment of the invention. The floor elements 1 are provided with edges 2, a lower side 7 and a decorative upper layer 3. The floor elements 1 are intended to be joined by means of tongue 12 and groove 11. The floor elements 1 are at their edges 2 provided with holes 4, which holes 4 extends inwards from the edge 2 mainly parallel with the decorative upper layer 3. The holes are arranged on a predetermined distance from the decorative upper layer 3 and on a predetermined distance from the closest corner (FIG. 1) between two adjacent edges 2. The holes 4 are intended to each receive one part of a guiding means 6. The holes 4 are provided with an inner gripping edge 4' which is achieved by milling a groove 4" from the lower side 7. See also FIG. 15. The groove 4" is perpendicular to the hole 4 and thereby parallel to the edge 2 where the hole 4, which is intersected by the groove 4", is arranged. The guiding means 6 is provided with two ends 6' each, which each are provided several resilient protrusions 60 which are intended to interact with gripping edges 4' of the holes 4 during assembly.

Figure 14:
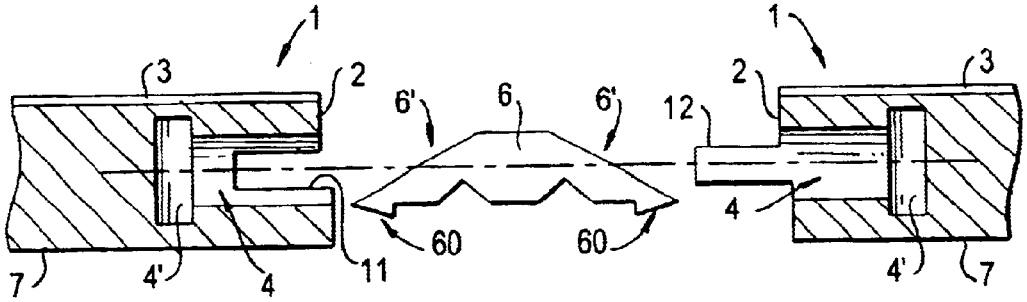
FIG. 14 shows, in cross-section, parts of two floor elements 1 and a guiding means 6 according to yet another embodiment of the invention.

FIG. 14 shows, in cross-section, parts of two floor elements 1 and one guiding means 6 according to yet another embodiment of the invention. The floor elements 1 are provided with edges 2, a lower side 7 and a decorative upper layer 3. The floor elements 1 are intended to be joined by means of tongue 12 and groove 11. The floor elements 1 are at their edges 2 provided with holes 4, which holes 4 extends inwards from the edge 2 mainly parallel with the decorative upper layer 3. The holes are arranged on a predetermined distance from the decorative upper layer 3 and on a predetermined distance from the closest corner (FIG. 1) between two adjacent edges 2. The holes 4 are intended to each receive one part of a guiding means 6. The holes 4 are provided with an inner gripping edge 4' which is achieved by milling a step with larger diameter than the holes 4 on a predetermined depth after the drilling. The guiding means 6 is provided with two ends 6' each, which each are provided several resilient protrusions 60 which are intended to interact with gripping edges 4' of the holes 4 during assembly.

Figure 15:
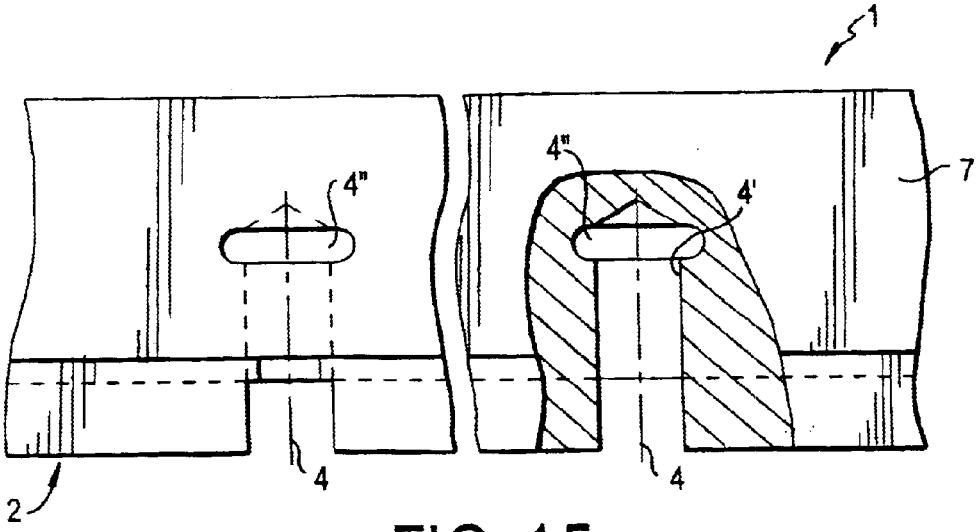
FIG. 15 shows, seen from below, parts of the floor element 1 showed in FIG. 13.

FIG. 15 shows, seen from below, parts of the floor element 1 shown in FIG. 13. The holes 4 are provided with an inner gripping edge 4' which is achieved by milling a groove 4" from the lower side 7. See also FIG. 13. The groove 4" is perpendicular to the hole 4 and thereby parallel to the edge 2 where the hole 4, which is intersected by the groove 4", is arranged.

The invention is not limited by the embodiments shown, since these can be varied in different ways within the scope of the invention. It is for example most advantageous to use glue when the floor elements 1 are to be joined even when embodiments with holes 4 having gripping edges 4' and guiding means with resilient protrusions 70 are used. These are foremost used for positioning the floor elements 1 so that gaps can be avoided and that a designed installation can be achieved by the one not skilled in the art without any need of special tools.

Floor elements 1 most often also includes a core covered with an upper decorative layer 3. The core is most often comprised by wood particles or wood fibre bonded with resin or glue. It is advantageous to surface treat the area around the joint if the floor is to be exposed to moisture since the wood of the core is sensitive to moisture. This surface treatment may suitably include resin, wax or some kind of lacquer. It is not necessary to surface treat the joint if it is to be glued as the glue itself will protect the core from moisture penetration. The decorative upper layer 3 is constituted by a decorative paper impregnated with melamine formaldehyde resin. One or more layers of so-called overlay paper of α-cellulose which is impregnated melamine formaldehyde resin may possibly be placed on top of this. One or a few of these layers may be sprinkled with hard particles of a-aluminium oxide, silicon carbide or silicon oxide during the impregnation in order to improve the abrasion resistance. The lower side 7 may suitably be surface treated with lacquer or a layer of paper and resin.

What is claimed is:

1. Floor element, which is mainly in the form of a board with triangular, quadratic, rectangular, rhomboidal or polygonal shape as seen from above, which floor element is provided with edges, a lower side and a decorative upper layer, and two or more floor elements intended to be joined via tongue and groove characterized, in that said floor element at all edges are provided with holes, which holes extend inwards from the edge mainly parallel to the decorative upper layer, that the holes are arranged at a predetermined distance from the decorative upper layer and at a predetermined distance from the closest corner between two adjacent edges, said holes being intended to each receive one part of a guiding means, whereby a) said floor element has four edges having the same length and each edge being provided with a group of holes, said group of holes being arranged at a mutual distance of N and with a distance of N/2 between said holes and a closest corner between two adjoining edges, whereby the edge as a length of 2N, or b) said floor element has two opposite edges having a length greater than remaining two edges, each shorter edge being provided with a group of two holes, which holes in each group of holes are arranged at a mutual distance of N and with a distance of N/2 between said holes and a closest corner between two adjoining edges, each longer edge being provided with a group of three or more holes of which the outermost holes are arranged at a distance of L/2 from respective closest corner between two adjoining edges, the distance between two adjacent holes, arranged on the longer edges, being L, 2L, 3L, 4L, 5L or a combination thereof, each long edge having a length being greater than 3L, L being equal to N;

wherein said holes are provided with an inner gripping edge and extend parallel to the edge joining closest to the edge at which the holes are arranged, and said inner gripping edge intersecting a lower side groove, which lower side groove is substantially perpendicular to the hole and thereby substantially parallel to the edge at which the hole, being intersected by the lower side groove, is arranged.

2. Floor element according to claim 1, characterized in that said holes extend perpendicularly from the edge at which said holes are arranged.

3. Floor element according to claim 1, characterized in that said holes are provided with an inner gripping edge obtained by milling a step having larger diameter on a predetermined depth after having drilled the hole.

4. Flooring comprising in combination:

at least one floor element according to claim 1, and at least one guiding means, wherein each guiding means has two ends, each end being provided with one or more resilient projections which during assembly are intended to intersect with the gripping edges of the holes.

5. Flooring according to claim 4, further comprising glue on the at least one floor element.

6. Floor element according to claim 1, wherein the edges defining the holes comprise a surface treatment.

7. Floor element according to claim 6, wherein the surface treatment comprises at least one material selected from the group consisting of resin, wax and lacquer.

8. Floor element according to claim 1, wherein the each long edge has a length greater than 30L.

9. A kit comprising:

at least one floor element according to claim 1, and at least one guiding means, wherein each guiding means has two ends, each end being provided with one or more resilient projections which during assembly are intended to intersect with the gripping edges of the holes.

10. Floor element according to claim 1, wherein the lower side groove intersects the lower side.

11. Floor element according to claim 1, characterized in that said lower side grooves are obtained by milling from the lower side.

12. Flooring element according to claim 11, wherein said holes are obtained by milling a step having larger diameter on a predetermined depth after having drilled the hole.

13. Flooring element according to claim 11, wherein said holes comprise a first section having a first cross-section and a second section having a second cross-section, wherein the first section is closer to the lower side and the first cross-section is smaller than the second cross-section, when viewed transverse to the edge of the flooring element, thus forming the inner gripping edge.

14. Floor element according to claim 11, wherein the each long edge has a length greater than 30L.

15. Floor element, which is mainly in the form of a board with triangular, quadratic, rectangular, rhomboidal or polygonal shape as seen from above, which floor element is provided with edges, a lower side and a decorative upper layer, and two or more floor elements intended to be joined via tongue and groove characterized in that said floor element at all edges are provided with holes, which holes extend inwards from the edge mainly parallel to the decorative upper layer, that the holes are arranged at a predetermined distance from the decorative upper layer and at a predetermined distance from the closest corner between two adjacent edges, said holes being intended to each receive one part of a guiding means, whereby a) said floor element has four edges having the same length and each edge being provided with a group of holes, said group of holes being arranged at a mutual distance of N and with a distance of N/2 between said holes and a closest corner between two adjoining edges, whereby the edge as a length of 2N, or b) said floor element has two opposite edges having a length greater than remaining two edges, each shorter edge being provided with a group of two holes, which holes in each group of holes are arranged at a mutual distance of N and with a distance of N/2between said holes and a closest corner between two adjoining edges, each longer edge being provided with a group of three or more holes of which the outermost holes are arranged at a distance of L/2 from respective closest corner between two adjoining edges, the distance between two adjacent holes, arranged on the longer edges, being L, 2L, 3L, 4L, 5L or a combination thereof, each long edge having a length being greater than 3L, L being equal to N;

wherein said holes are provided with an inner gripping edge and extend parallel to the edge to the edge at which the holes are arranged, characterized in that said holes are provided with an inner gripping edge obtained by milling a groove from the lower side, which groove is perpendicular to the hole and thereby parallel to the edge at which the hole, being intersected by the groove, is arranged.

16. Floor element, having a polygonal shape as seen from above, which floor element is provided with edges, a lower side, a core formed from wood particles or wood fibre, and a decorative upper layer, and two or more floor elements intended to be joined via tongue and groove characterized in that said floor element at all edges is provided with holes, which holes extend inwards from the edge mainly parallel to the decorative upper layer, that the holes are arranged at a predetermined distance from the decorative upper layer and at a predetermined distance from the closest corner between two adjacent edges, said holes being intended to each receive one part of a guiding means, whereby a) said floor element has four edges having the same length and each edge being provided with a group of holes, said group of holes being arranged at a mutual distance of N and with a distance of N/2 between said holes and a closest corner between two adjoining edges, whereby the edge as a length of 2N, or b) said floor element has two opposite edges having a length greater than remaining two edges, each shorter edge being provided with a group of two holes, which holes in each group of holes are arranged at a mutual distance of N and with a distance of N/2 between said holes and a closest corner between two adjoining edges, each longer edge being provided with a group of three or more holes of which the outermost holes are arranged at a distance of L/2 from respective closest corner between two adjoining edges, the distance between two adjacent holes, arranged on the longer edges, being L, 2L, 3L, 4L, 5L or a combination thereof, each long edge having a length being greater than 3L, L being equal to N;

wherein said holes are surrounded by the core of the board provided with an inner gripping edge.

* * * * *